US005521613A

United States Patent [19]

Hayashi

[11] Patent Number: 5,521,613

[45] Date of Patent: May 28, 1996

[54] DISPLAY CONTROLLER

[75] Inventor: Kazuo Hayashi, Itami, Japan

[73] Assignee: Mitsubishi Denki Kabushiki Kaisha, Tokyo, Japan

[21] Appl. No.: 215,404

[22] Filed: Mar. 21, 1994

Related U.S. Application Data

[63] Continuation of Ser. No. 834,437, Feb. 12, 1992, abandoned.

[30] Foreign Application Priority Data

Feb. 12, 1991 [JP] Japan ..... 3-040980

[51] Int. Cl.[6] ..... G09G 5/40

[52] U.S. Cl. ..... 345/116; 345/192; 348/563

[58] Field of Search ..... 340/748, 750, 340/790, 721; 358/160, 183; 345/25, 26, 27, 28, 141, 116, 200, 192, 194; 348/563, 564; H04N 5/445

[56] References Cited

U.S. PATENT DOCUMENTS 3,911,404 10/1975 O'Neill, Jr. ..... 340/748

4,814,756 3/1989 Chauvel ..... 340/750

FOREIGN PATENT DOCUMENTS

2854348A1 6/1979 Germany .

3046513A1 7/1982 Germany .

*Primary Examiner*—Richard Hjerpe

*Assistant Examiner*—Chanh Nguyen

*Attorney, Agent, or Firm*—Townsend and Townsend and Crew

[57] ABSTRACT

To minimize the capacity of a random access memory for storing display data of a display controller for displaying characters or the like on a television screen, the display data is divided into the data for characters or the like and the blank data free from characters with a discriminator, the data for characters or the like are stored in the random access memory every unit address, the number of non-characters shown by the blank data is counted by a counter, and the cumulative counted number is stored in the unit address of the random access memory. When the blank data is displayed, the counted number is read from the random access memory and non-character signals equivalent to the counted number are output to a display unit.

1 Claim, 7 Drawing Sheets

DISPLAY CONTROLLER

This is a continuation of application Ser. No. 07/834,437, filed Feb. 12, 1992, now abandoned.

BACKGROUND OF THE INVENTION

1. Field of the Invention

The present invention relates to a display controller for displaying characters, graphics, and symbols (hereafter referred to as characters) on a television screen.

2. Description of the Prior Art

It is conventionally performed to display channels and characters and patterns expressing various operating states on a television screen. FIG. 6 is a block diagram showing this type of the existing display controlled.

Horizontal synchronizing signals are input to the H (horizontal) counter 1 and the H counter 1 is reset by each vertical synchronizing signal for changing the screen. The value counted by the H counter 1 serves as a criterion for determining the position of a character or pattern to be displayed on the screen.

Code data and address data to be displayed are input to the input control circuit 2 from a CPU not illustrated.

Meanwhile, in FIG. 5, the television screen T is sectioned into squares consisting of "j" rows and "i" columns (j×i) for display of characters or the like, which are set so that one basic character will be set to each square P. For an actual television screen, characters to be displayed use the bottom or top portion of the screen T and the entire screen T is rarely filled with characters. Therefore, some of squares P among those consisting of "j" rows and "i" columns are frequently filled with characters.

The write control circuit 6 divides input data into address data according to the sequence of the above squares P and data for the code of character or blank (non-character) to be set to the address and records the data in the display data RAM7 in order of address.

Because the height of each square P is specified by the number of horizontal synchronizing signals (raster), the horizontal synchronizing signal is also given to the write control circuit 6.

In FIG. 5, the case is assumed in which input data values for specifying characters A and B are set to the fifth and sixth squares P from the top left, those for specifying characters Y and Z are set to the second and first squares P from the bottom right, and non-characters are set to other squares.

The write control circuit 6, as shown in FIG. 7, records characters and non-characters (blanks) in the display data RAM7 so that squares P will correspond to addresses "a", "a+1", . . . , and "a+i j−1" one each.

Numeral 9 is a character ROM which outputs the character font read according to the character code recorded in the RAM7. The read control circuit 13 synchronizes with the horizontal synchronizing signal to read the character codes from the RAM7 and send them to the display control circuit 11. The display control circuit 11 displays the character font and non-character (blank) signal sent from the character ROM9 at the specified screen position of the CRT14. Video signals are also input to the CRT14 from a television circuit not illustrated and the character font or the like superimposed on the picture is displayed.

Because a semiconductor device having the conventional display control circuit is configured as shown above, it stores a not-displayed character (blank) position in the memory on a RAM by making it correspond to the data for one character. Therefore, there is the problem that a large-capacity display data RAM is required even for a system actually having the small number of display characters on the screen.

SUMMARY OF THE INVENTION

The present invention is made to solve the above problem. For a system actually having the small number of display characters on the screen, it is an object of the present invention to obtain a semiconductor device having a display control circuit requiring only a small display data RAM.

Therefore, the display controller related to the present invention comprises a display unit 14 for displaying the unit character or the like in the unit area P formed by sectioning the display screen T, a discriminator 3 for dividing input display data into data for unit character data or the like and unit blank data free from characters, a counter 5 for inputting blank data from the discriminator 3 and counting the number of continuous unit blank data values, a random access memory 7 for storing the data for unit character or the like sent from the discriminator 3 in the unit address and the counted value of the unit blank data sent from the counter 5 in the unit address, a blank counter 8 for dividing display data sent from the random access memory 7 into data for unit character or the like and the counted unit blank data, a read only memory 9 for inputting the data for unit character or the like and outputting the font for characters or the like, a blank control circuit 10 for inputting the counted. Blank data and outputting more than one blank signal, and a display control circuit 11 for inputting the font for characters or the like and more than one blank signal and displaying characters or the like on the display unit 14.

That is, the capacity of the random access memory 7 can be decreased because the random access memory 7 stores unit blank data in the unit address by compressing the number of continuous data values as a counted value.

When blank data is read from the random access memory 7, the blank counter 8 separates blank data and the blank control circuit 10 outputs more than one blank signal corresponding to the counted value from the blank date. Therefore, the character array intended by input data is displayed on the display unit 14.

The above and other objects, features, and advantages of the invention will become more apparent from the following description when taken in conjunction with the accompanying drawings.

DESCRIPTION OF THE PREFERRED EMBODIMENT

The present invention is described below according to the drawings.

Figure 1:
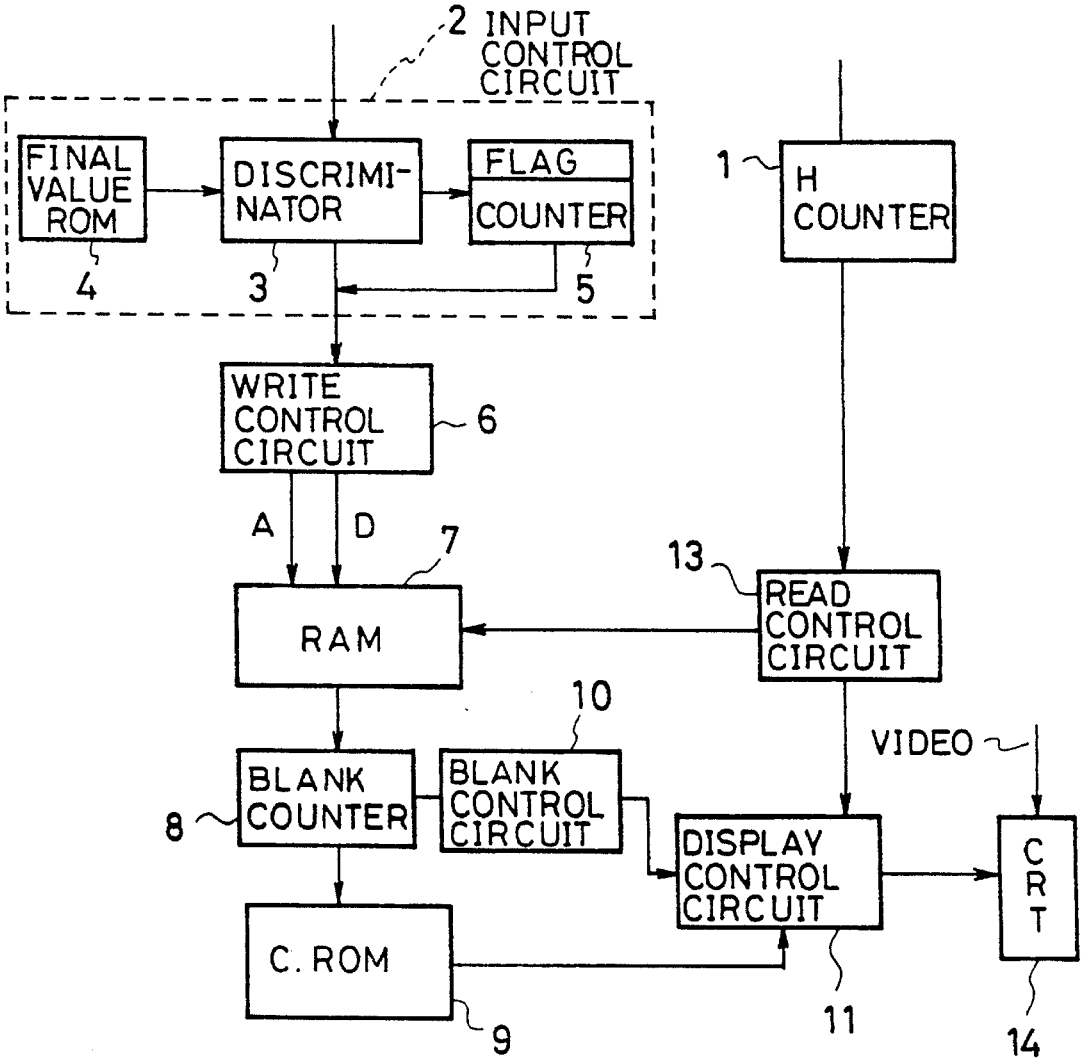
FIG. 1 is a block diagram showing the configuration of the display controller according to one embodiment of the present invention.
Figure 2:
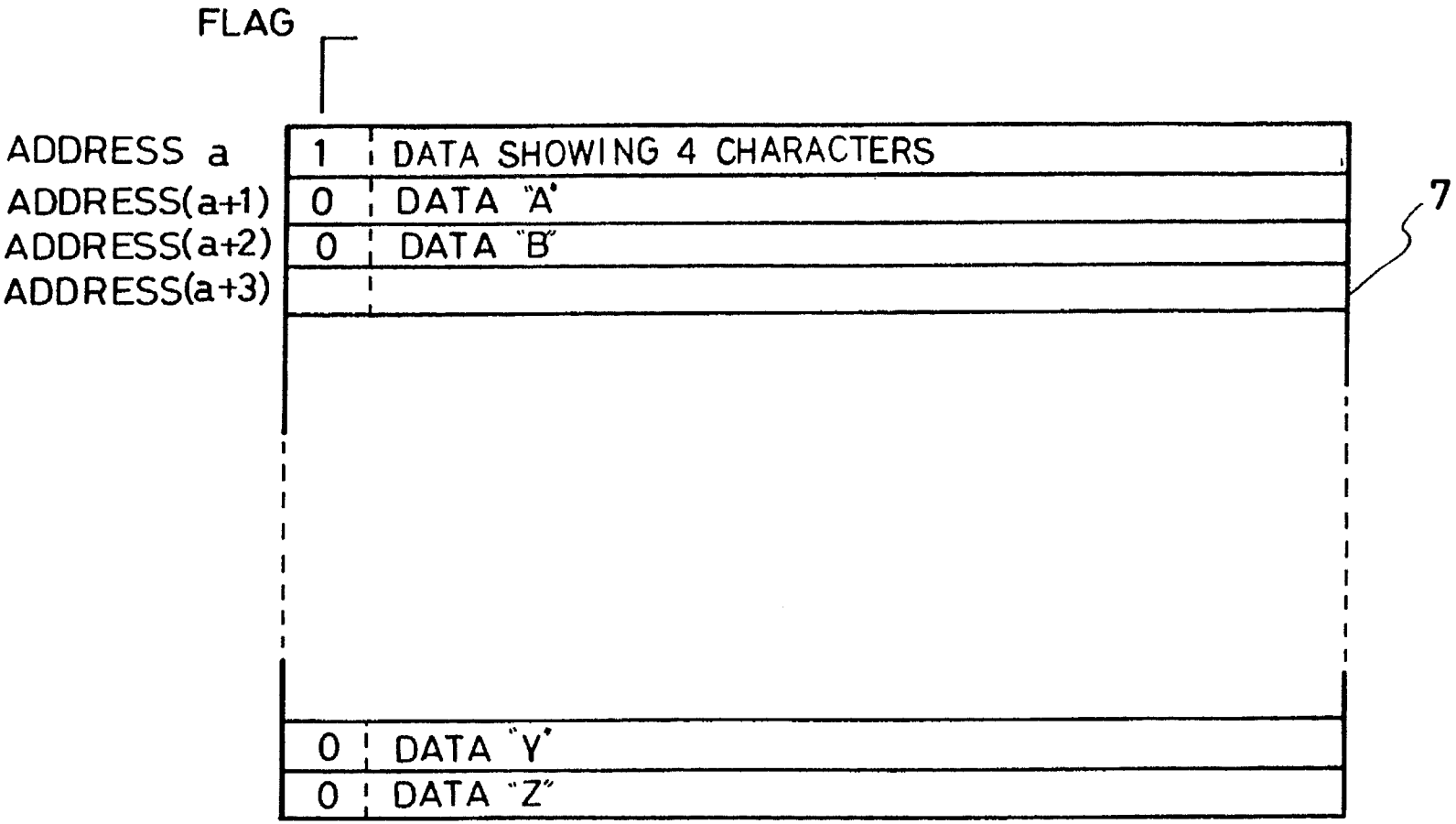
FIG. 2 is an illustration showing the memory configuration of the RAM of the embodiment.

In FIG. 1, the horizontal synchronizing signal is input to the horizontal (H) counter 1 which is reset every vertical synchronizing signal for changing the screen. Values counted by the H counter 1 are used for the criteria for determining the positions of characters and patterns to be displayed on the screen.

Code data and address data to be displayed are input to the input control circuit 2 from a CPU not illustrated.

Figure 5:
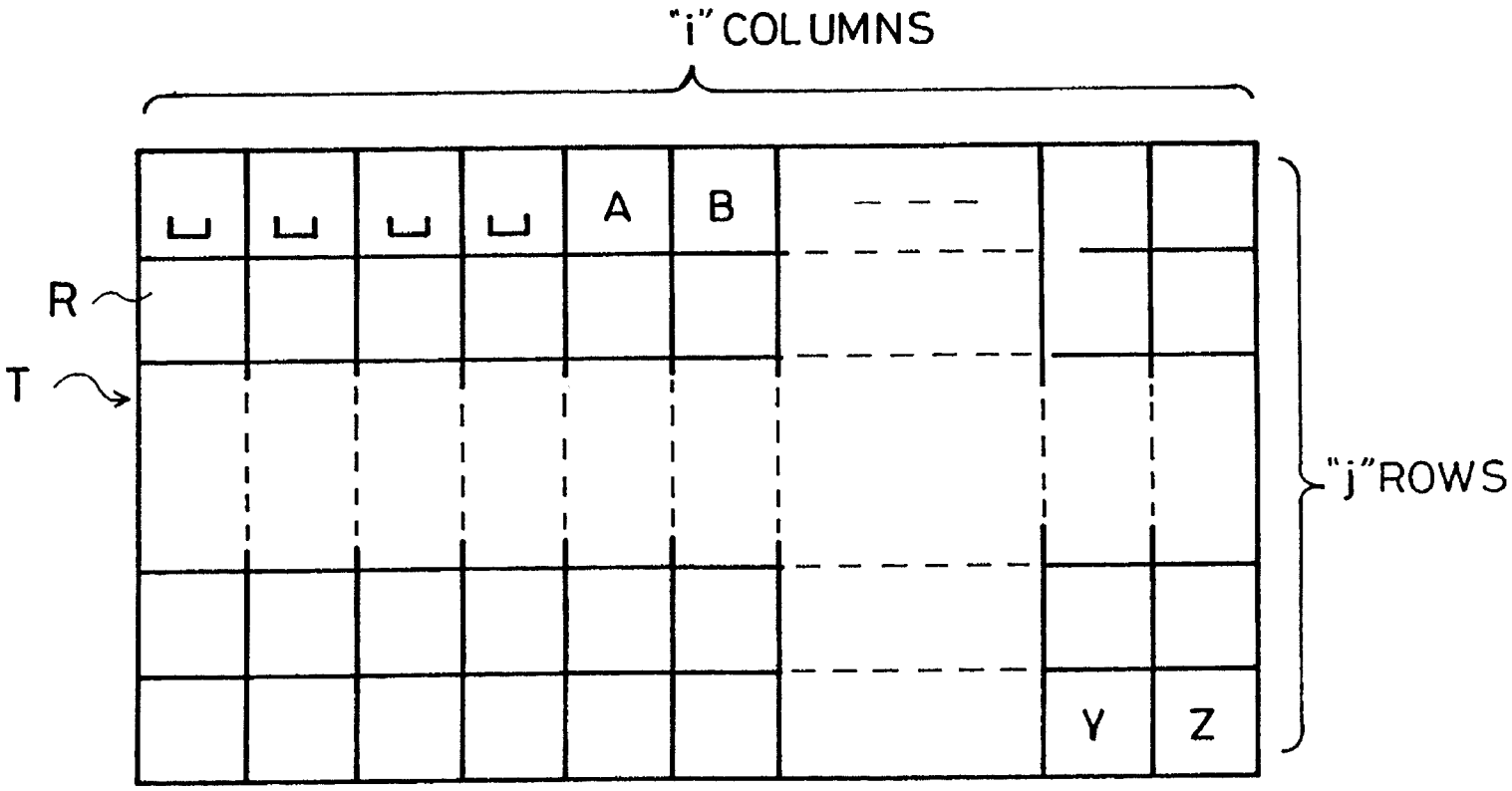
FIG. 5 is an illustration showing general configuration of a display screen.
Figure 6:
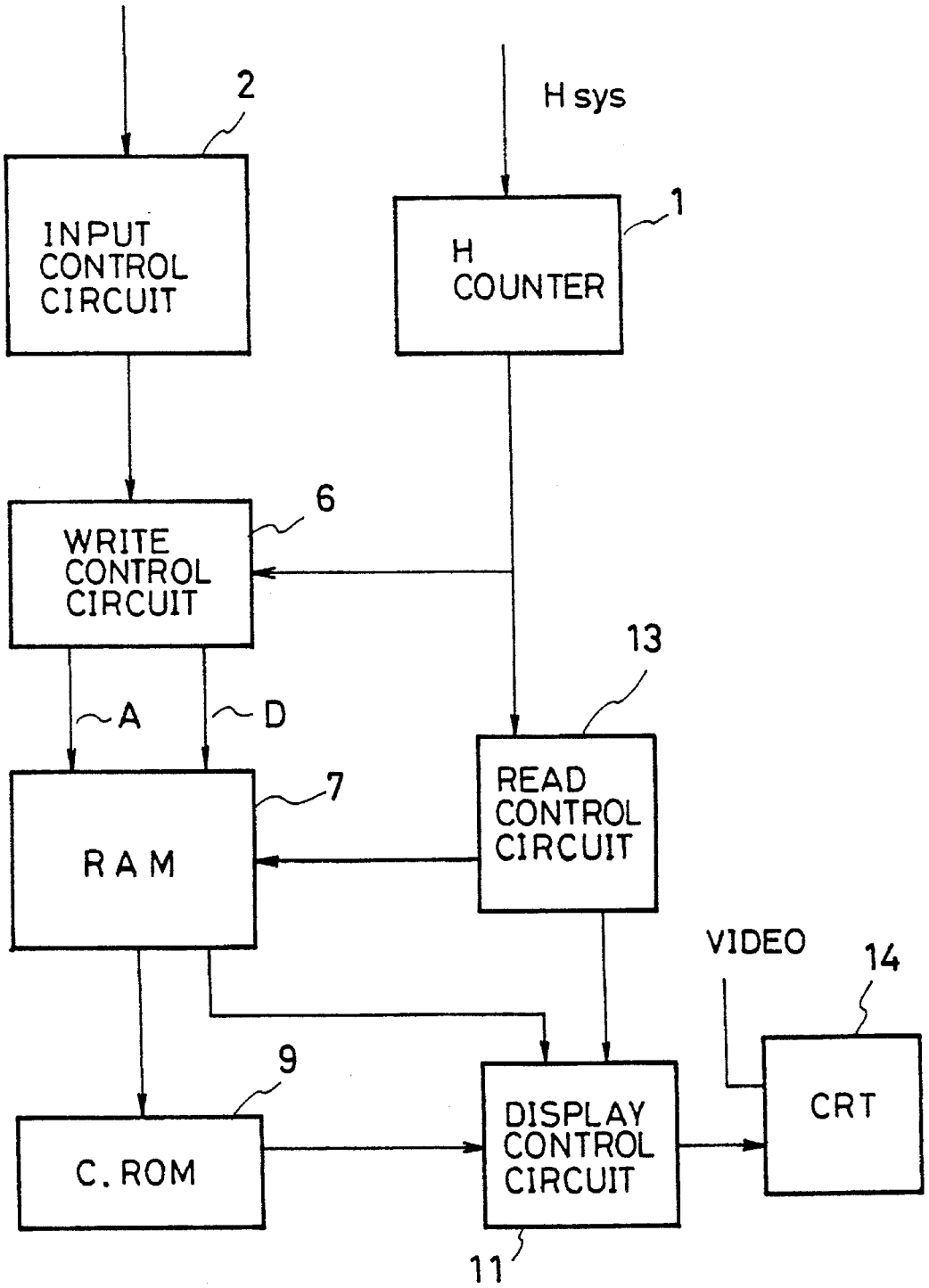
FIG. 6 PRIOR ART
FIG. 6 is a block diagram showing the configuration of a conventional display controller.

Hereupon, in FIG. 5, the television screen T is sectioned into squares consisting of "j" rows and "i" columns (j×i), which are set so that one basic character will be set to each square P. For an actual television screen, characters to be displayed use the bottom or top portion of the screen T and the entire screen T is rarely filled with characters. Therefore, some of squares P among those consisting of "j" rows and "i" columns are frequently filled with characters.

Meanwhile, data for displaying required characters or patterns or identification data for displaying no characters (blank signal) and data for its number of squares and addresses are input to the input control circuit 2.

The input control circuit 2 consists of final value ROM4 for storing the (i·j) number of the final square, discriminator 3, and counter 5. The discriminator 3 judges whether input data has character code or it is non-character (blank) signal. When non-character signals are given to the counter 5 from the discriminator 3, the counter 5 sets the flag 1, counts the number of signals, and temporarily stores them.

The write control circuit 6 sets "1" to the flag area in the RAM7 when data is sent from the counter 5 to make the RAM7 directly store the counted number of non-characters (blanks). The write control circuit 5 divides the input data into the addresses according to the sequence of the above squares P and the code data for characters or blanks (non-characters) set the addresses and records the data in the display data RAM7 in order of address. Display characters for one screen are stored in the RAM (random access memory) 7. Because the height of each square P is specified by the number of horizontal synchronizing signals (raster), the horizontal synchronizing signal is also given to the write control circuit 6.

In FIG. 5, the case is assumed in which input data values for specifying characters A and B are set to the fifth and sixth squares P from the top left, those for specifying characters Y and Z are set to the second and first squares P from the bottom right, and non-characters are set to other squares. Numeral 9 is a character ROM which outputs the character font read according to the character code recorded in the RAM7. The read control circuit 13 synchronizes with the horizontal synchronizing signal to read the character codes from the RAM7 and send them to the display control circuit 11. The display control circuit 11 displays the character font sent from the character ROM9 and the non-character (blank) signal sent from the blank control circuit 10 at the specified screen position of the display unit CRT14. Video signals are also input to the CRT14 from a television circuit not illustrated and the character font or the like superimposed on the picture is displayed.

Meanwhile, data recorded in the RAM7 is given to the character ROM9 or the blank control circuit 10 through the blank counter 8. The blank counter 8 sends the data sent from the RAM7 to the blank control circuit 10 if the flag "1" is set to the data and to the character ROM9 as character code data if the flag "0" is set to the data.

When the blank control circuit 10 receives the blank (non-character) signal sent from the blank counter 8, it sends a command to the display unit (CRT) 14 to make the display control circuit 11 display non-character signals in the squares equivalent to the number of counted values.

Figure 3:
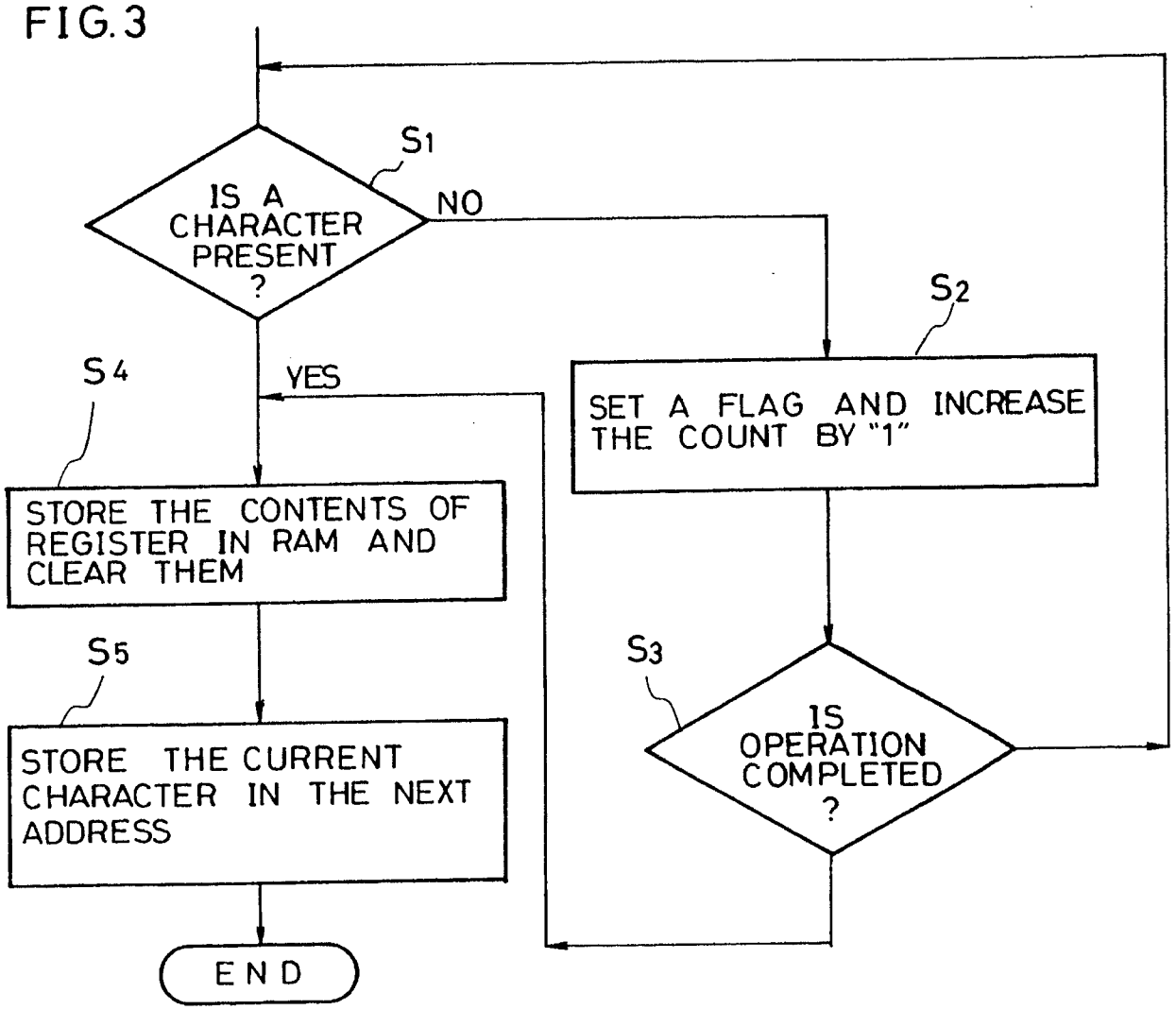
FIG. 3 is a flow chart showing write operation of the embodiment.

Then, operations are described below according to FIGS. 3 and 4. FIG. 3 shows the operation to write data in the RAM7 and FIG. 4 shows read operation.

Figure 7:
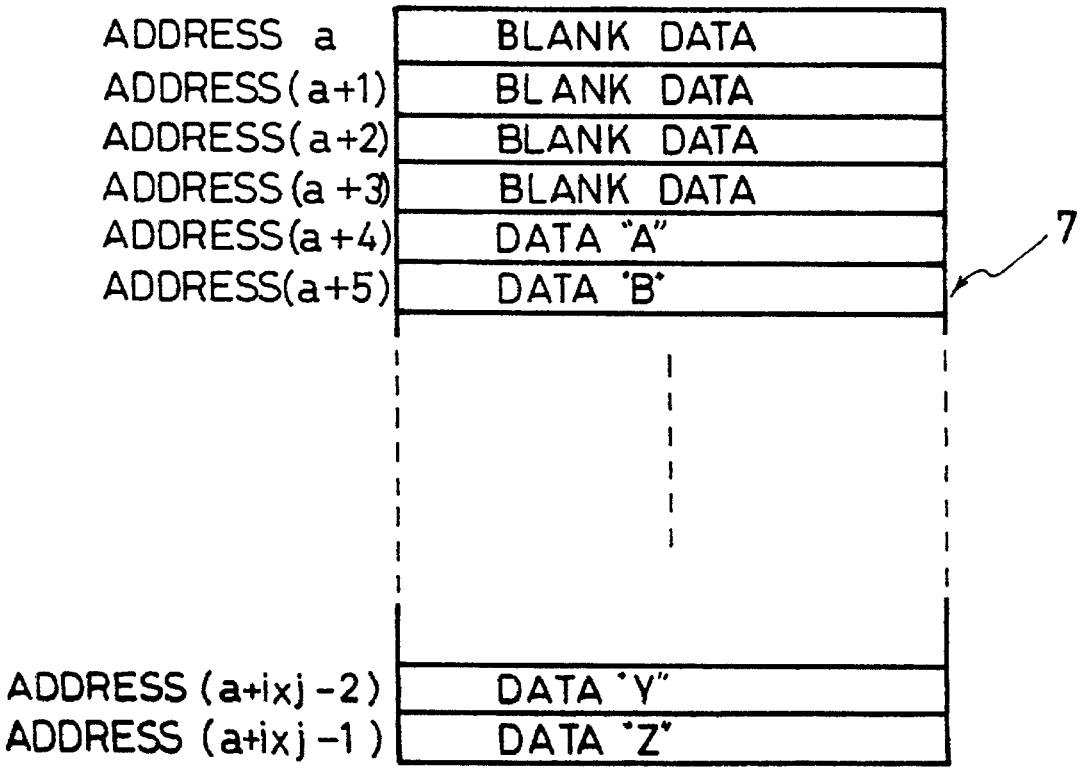
FIG.7 PRIOR ART
FIG. 7 is an illustration showing the RAM memory configuration of the conventional embodiment.

When input data is input, the discriminator 3 of the input control circuit 2 discriminates character signals from non-character blank signals (step S1). If the input data is non-character signals, the discriminator 3 starts the step S2, sets "1" to the flag of the counter 5, and counts "+1". Then, the discriminator 3 executes comparison with the contents of the final-value ROM4 on whether or not the address of the input data shows the position of the final square (step S3). Unless the address shows the screen final square P, the discriminator 3 returns to the step S1 to wait for the next input data. When non-character data is continuously input, steps S1, S2, and S3 are repeated and the counted value is increased by the number of non-characters (blanks). If there is any character in the step S1, steps S1 through S4 are executed. In the step S4, the write control circuit 6 reads the the number of blanks for continuous no-characters and the counted number from the counter 5, stores the data in the unit address "a" of the RAM7 as shown in FIG. 7, and clears all data in the counter 5. Then, the circuit 6 stores the currently-input character data in the next address "a+1" of the RAM7 in characters.

If the blank address is at the final position of the screen T in the step S3, the circuit 6 records the cumulative counted number in the RAM7 in the step S4 because the screen changes. Therefore, when the blank signal is input to the RAM7 from the counter 5, the flag 1 is set to one address and the counted number is recorded. For character signal, one character is recorded in the next one address.

Figure 4:
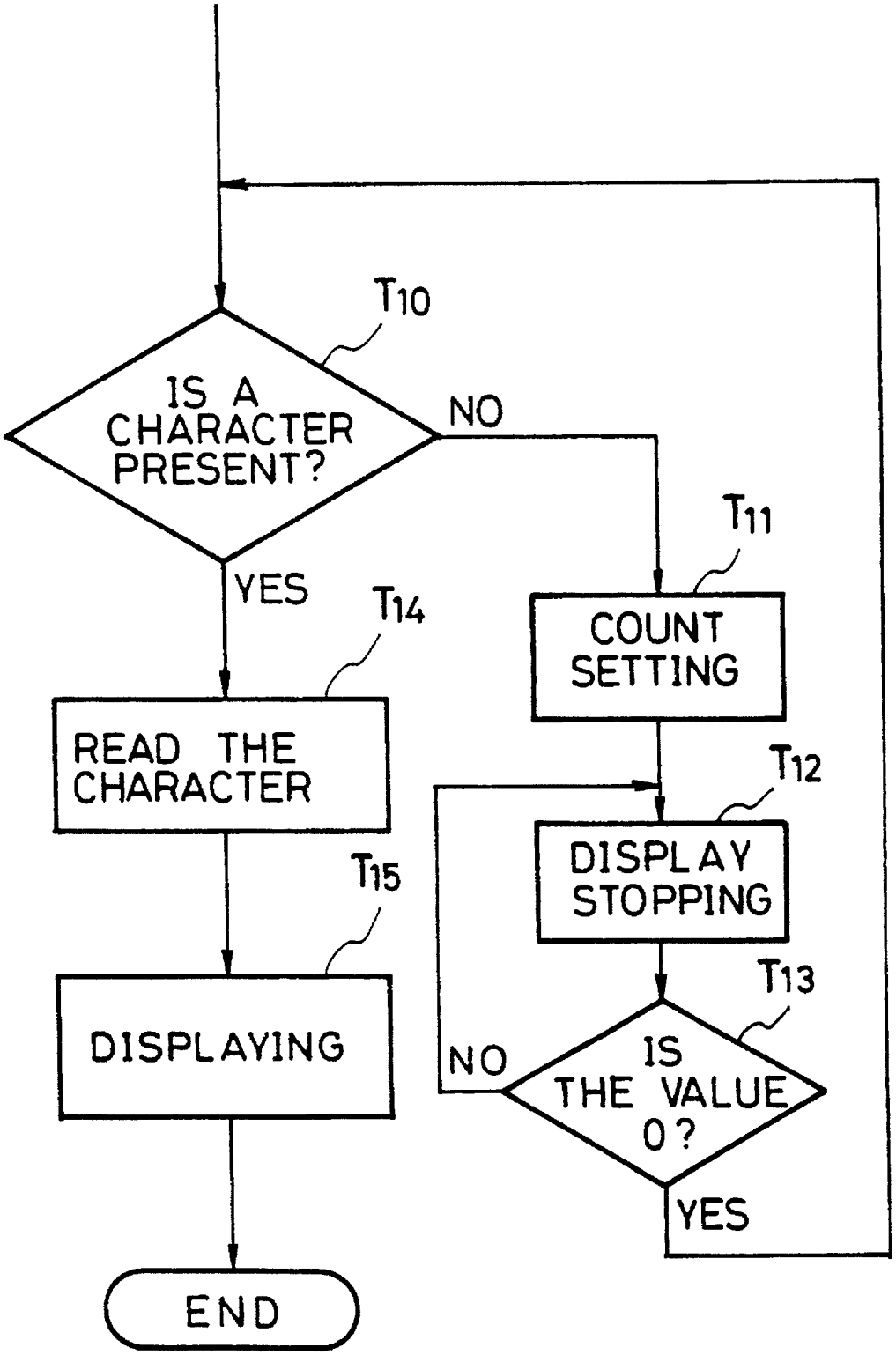
FIG. 4 is a flow chart showing read operation of the embodiment.

The following is the description of read operation according to FIG. 4.

The read control circuit 13 commands the RAM7 to read characters and non-characters (blanks). The blank counted 8 judges whether the data sent from the RAM7 is a character or blank according to the flag state (step T10). If the data of the flag 1 is present, the counter 8 advances to the step T11 because the data is the blank signal and sets the counted value to the blank control circuit 10. The blank control circuit 10 sends the blank signal (character display stop signal) to the display control circuit 11 and subtracts "1" from the counted number (step T12). Unless the counted value is "0" in the step T13, the circuit 10 returns to the step T12 and repeats outputting the blank signal until the counted number decreases to "0". After outputting the blank signals equivalent to the counted number, the circuit 10 returns to the step T10 to check the next character data sent from the RAM7. Then the circuit 10 advances to the step T14 because character data is present, reads the character font concerned according to the decode data from the character ROM9, and displays characters on the CRT14 through the display control circuit 11 in the step T15. That is, the RAM7 outputs previously-written data. If the data is character code, the RAM7 gives the address corresponding to the character code data to the character ROM9 and, responsively to this, character font is read from the character ROM9.

Meanwhile, when the data output from the display data RAM7 is not character code but identification data not to be displayed (number of blanks at the flag 1), the blank counter 8 discriminates the above identification data and sends the counted value to the blank control circuit 10. The blank control circuit 10 sends the blank signal to the display control circuit 11 to make it stop displaying characters and other patterns.

For the above embodiment, the description is made for the character data of one byte. However, the character data of two bytes or more is also allowed.

Also, for the above embodiment, the description is made for the case in which the identification data not to be displayed is the flag of one bit. However, the flag of two bits or more is also allowed.

Thus, according to the present invention, blank data not to be displayed can be compressed because the display controller comprises a display unit for displaying the unit character or the like in the unit area formed by sectioning a display screen, a discriminator for dividing input display data into the data for unit character or the like and the unit blank data free from character, a counter for inputting blank data sent from the discriminator and counting continuous unit blank data, a random access memory for storing the data for unit character or the like sent from the discriminator in the unit address and the counted value of the unit blank data sent from the counter in the unit address, a blank counter for dividing the display data sent from the random access memory into the data for unit character or the like and the counted data of unit blank data, a read only memory for inputting the data for characters or the like and outputting the font for characters or the like, a blank control circuit for inputting counted unit blank data and outputting more than one blank signal, and a display control circuit for inputting the character font and the above more than one blank signal and displaying characters or the like on the above display unit. Thus, the capacity of the display RAM can be decreased. Therefore, because a small-capacity and inexpensive RAM can be used, a low-price display controller is realized as a whole.

What is claimed is:

1. A display controller for displaying characters, such as channel numbers and operating modes, on a television screen that receives characters to be displayed and blanks indicating that no character is to be displayed, for sectioning the television screen into unit areas and for controlling the television screen to display a character or blank in each unit area,, said display controller comprising:

a discriminator, that receives characters and blanks to be displayed, and asserts a first signal only when a blank is received;

an input counter and flag register, having an input coupled to said discriminator, for setting a flag value to a set flag value in said flag register and incrementing a count value whenever said first signal is asserted to generate a repetition value and for resetting said flag value to a reset flag value and said count value to zero when said first signal is not asserted;

a random access memory (RAM) having a plurality of addressable storage locations, each addressable storage location having a flag area for storing flag data and a data area for storing character data, with character data specifying either a received character or a repetition value specifying a number of repeated blanks to be displayed on the television screen;

a write-control circuit, coupled to said discriminator and input counter and flag register and responsive to said first signal, for, when a received character other than a blank is received at said discriminator causing said first signal not to be asserted and when said flag value has been previously set, writing only said set flag value, to said flag area of a first addressable storage location, and a repetitive value, indicating a number of successive blanks, as character data to the data area of said first addressable storage location in said RAM, prior to the resetting of said flag and count values in said input counter and flag register, and for writing a reset flag value to said flag area of a second addressable storage location and said received character as character data to the data area of said second addressable storage location in said RAM after said flag value is reset;

a character ROM for receiving character data as address data and providing fonts as output data;

an output counter, coupled to said RAM, for receiving said flag data from the flag area and said character data from the data area of a selected storage location and, when said received flag data is equal to the set flag value, for setting its count value to a set count value equal to the repetition value stored in the data area of said selected storage location as character data, for asserting a second signal when said set count signal has a non-zero value, and for decrementing the set count value subsequent to asserting the second signal and, when said received flag data is equal to the reset flag value, and for transferring a received character stored in the selected storage locations as character data to the character ROM;

a control circuit, coupled to said output counter to receive said second signal, for asserting a third signal whenever said second signal is asserted; and a display control circuit, having inputs coupled to said character ROM and said control circuit, for causing said display unit to display a blank when said third signal is asserted and to display a font, addressed by a character retrieved from the selected storage location as non-flag data, from said character ROM when the third signal is not asserted.

* * * * *